United States Patent [19]

Garrison et al.

[11] 4,234,822

[45] Nov. 18, 1980

[54] CONTROL CIRCUIT PROVIDING CONSTANT POWER SOURCE

[75] Inventors: Robert L. Garrison, Henniker, N.H.; James C. Morris, Wakefield, Mass.

[73] Assignee: GTE Products Corporation, Stamford, Conn.

[21] Appl. No.: 902,456

[22] Filed: May 3, 1978

[51] Int. Cl.[3] ..... H05B 37/02; H05B 39/04; H05B 41/36

[52] U.S. Cl. ..... 315/209 R; 315/DIG. 5; 315/DIG. 7; 315/224; 315/240; 315/242

[58] Field of Search ..... 315/224, 242, 243, 244, 315/DIG. 5, DIG. 7, 240, 443, 209

[56] References Cited

U.S. PATENT DOCUMENTS

| | | | |
|---|---|---|---|
| 3,629,683 | 12/1971 | Nuckolls | 315/242 |
| 3,736,465 | 5/1973 | Rowe | 315/244 |
| 3,771,014 | 11/1973 | Paget | 315/243 |
| 3,780,342 | 12/1973 | Grimshaw et al. | 315/243 |
| 3,962,601 | 6/1976 | Wrzesinski | 315/243 |
| 3,969,652 | 7/1976 | Herzog | 315/306 |
| 4,005,337 | 1/1977 | Rabe | 315/224 |
| 4,092,564 | 5/1978 | Soileau | 315/242 |

*Primary Examiner*—Saxfield Chatmon, Jr.
*Attorney, Agent, or Firm*—Edward J. Coleman

[57] ABSTRACT

A circuit for starting and operating an arc lamp includes a full wave rectifier having an input connected to a source of alternating current line voltage and a pair of output terminals having a filter capacitor connected thereacross for providing a source of direct current voltage. Connected to one of the direct current terminals is a resonant charging circuit comprising a controlled rectifier switch, an inductor and a capacitor serially connected in a circuit loop. Another inductor, which may comprise the secondary winding of a starting pulse transformer, is connected between the output of the resonant circuit and one of the supply terminals for the arc lamp to provide the dual function of both averaging filter and lamp ballast. The reference terminal of the direct current source is connected to the other arc lamp supply terminal and through a back swing diode to the output of the resonant circuit. A trigger pulse generator is coupled to the resonant charging circuit for intermittently operating the controlled rectifier switch, and a voltage divider is connected across the direct current source for sensing changes in the line voltage and adjusting the pulse rate of the trigger generator in response thereto. In this manner, once the arc lamp is started and operating, the resonant charging circuit maintains a source of constant power to the arc lamp regardless of line voltage variations. Protective sensing circuitry is also provided for controlling the trigger generator output in the event the line voltage is too low, the load current is too high, or the resonant circuit capacitor has not discharged to zero.

14 Claims, 3 Drawing Figures

CONTROL CIRCUIT PROVIDING CONSTANT POWER SOURCE

BACKGROUND OF THE INVENTION

This invention relates generally to control circuits for operating load devices and, more particularly, to an improved circuit for starting and operating arc lamps.

Although applicable to a variety of load devices, such as arc discharge lamps, the present invention is particularly useful in connection with short arc metal halide lamps in which a pair of electrodes are spaced to provide an arc in the order of one quarter inch within a quartz envelope having a filling including selected metal additives in the form of halogen compounds, generally known as iodides, to achieve desired alterations in lamp discharge characteristics. Such lamps, which are often used for applications such as light sources in projectors, impose severe operating and starting requirements on the associated power supply. Typically, such lamps have a start or breakdown voltage in the order of thousands of volts for pulsing the lamp to initiate electrical conduction across the arc spacing. As the lamps begin to operate, they have a requirement for an intermediate voltage in the order of hundreds of volts for carrying the conduction breakdown region of the lamp through to a point where the lamp can be continuously operated with a comparatively low supply voltage, e.g. about 40 volts.

As mentioned above, applications for which such metal halide lamps are particularly suited are projection lighting systems that may be used in theaters or class rooms, and also in homes. It is desirable, therefore, that the power supply for such a lamp be compact, light weight, and operable from a conventional 120 volt, 60 Hertz source of alternating current line voltage. Further, it should be safe and relatively simple to operate. With respect to performance, the quality and uniformity of color temperature and light output from lamp to lamp and over the life of a given lamp are significant factors in such applications. In order to extend useful lamp life and maintain the desired uniform output characteristics, the lamp supply circuit should maintain a constant power level notwithstanding the typical variations in line voltage.

Various types of ballast circuits are well known in the art for controlling the operation of arc discharge lamps. For example, U.S. Pat. No. 3,987,339 describes a transformer for ballast circuit for providing constant power to a high intensity discharge lamp. Although affording desired power control, this transformer approach presents the disadvantages of adding to the weight, bulk and cost of the power supply. U.S. Pat. No. 3,967,159 employs an over voltage feedback circuit from the load and a duty cycle modulator in a comparatively complex circuit for providing a constant current for a laser or gas discharge lamp. The circuit does not directly sense line voltage variations, and does not discuss maintaining a constant source of power. U.S. Pat. No. 3,700,962 describes a doubler switching ballast circuit for controlling mercury arc lamps. A photoconductive element responds to variations in the light output of the lamp to control doubler switching so as to automatically vary the effective power supplied to the lamp to maintain a more constant light output under conditions of varying supply line voltage or lamp aging. Again, there is no direct sensing of the line voltage and a form of load feedback circuit is required; further, the patent refers to varying power and does not mention maintaining a constant source of power. U.S. Pat. Nos. 3,328,673 and 3,344,311 describe control circuits which do show direct line voltage sensing means employing an incandescent lamp and photoconductor. Constant current is maintained through the load by a pair of AC operated phase controlled switches. In addition to having a somewhat cumbersome arrangement, the last-mentioned circuits employ a form of chopper control with the attendant disadvantage of providing a source of possible radio frequency interference (RFI) problems. The following patents are of general interest with respect to starting and operating circuits for arc lamps and include a reactor ballast on the AC side of the full wave rectifier: U.S. Pat. Nos. 3,467,886; 3,780,342; and 4,045,709.

In contrast to many of the aforementioned prior art circuits, the present invention provides a constant power source for a load, such as an arc lamp, without connecting feedback monitoring circuits to the lamp. Further, the current flow in the resonant circuit has a half sine wave pulse shape, which causes less RFI than the rectangular pulse shape of the prior art switching circuits. In addition to providing a constant power regardless of line voltage variations, the control circuit of the invention also provides the necessary voltages for lamp starting in an efficient, low cost manner which minimizes the bulk and weight of the system.

SUMMARY OF THE INVENTION

Accordingly, it is an object of the present invention to provide an improved control circuit for providing constant power to a load.

It is a more particular object of the invention to provide an improved power supply for starting and operating arc lamps.

A principle object is to provide a power supply for a metal halide short arc lamp which provides the necessary starting voltages and maintains a constant source of power to the lamp by an efficient, low cost circuit arrangement which is suitable for compact, light weight packaging.

A further object is to provide suitable protective means in such circuitry for preventing circuit or lamp malfunctions.

Briefly, these and other objects, advantages and features are attained, in accordance with the invention, by a control circuit comprising a full wave rectifier means having an input for connection to a source of alternating current line voltage and a pair of direct current output terminals, one of which is connected to the input of a resonant charging circuit including a unidirectional controlled switch. An averaging filter is connected between the output of the resonant charging circuit and a supply terminal for connection to the load means. The second output terminal of the rectifying means is connected to a second supply terminal for the load and also through a diode to the output of the resonant charging circuit. Trigger pulse generating means is connected to the unidirectional control switch for intermittently operating the same, and means is connected across the output terminals of the rectifying means for sensing changes in the line voltage and adjusting the pulse rate of the trigger generating means in response thereto. In this manner, the resonant charging circuit maintains a source of constant power to a load connected to the supply terminals regardless of line voltage variations.

A significant aspect of the invention is the resonant charging circuit, which comprises the unidirectional control switch, an inductor means, and a capacitor means serially connected in that order in a circuit loop. The mode of power control provided by this comparatively simple, low cost circuit arrangement obviates the need for a load feedback circuit for providing regulation and significantly reduces radio frequency noise output.

In order to provide protection against circuit malfunctions, the trigger circuitry includes sensing means for delaying or terminating the trigger pulse output in response to a drop in the line voltage below a predetermined level, a charge on the resonant circuit capacitor which exceeds zero, or a load current which exceeds a predetermined threshold level.

In a preferred embodiment, the load means is an arc lamp, and the averaging filter is a series inductor which functions as a ballast for the arc lamp. The series inductor ballast also comprises the secondary winding of a pulse transformer forming part of a starting circuit for introducing a high voltage pulse to initiate electrical conduction through the arc lamp. The circuitry further includes means for aiding the lamp starting circuit by supplying an intermediate voltage level for carrying the conduction breakdown region of the lamp through to a point where the source of constant power from the resonant charging circuit can operate the lamp. This intermediate voltage supply means shares components with both the starting circuit and the resonant charging circuit to contribute toward minimizing both the complexity and cost of the overall circuit.

BRIEF DESCRIPTION OF THE DRAWINGS

This invention will be more fully described hereinafter in conjunction with the accompanying drawings in which.

DESCRIPTION OF THE PREFERRED EMBODIMENT

Figure 1:
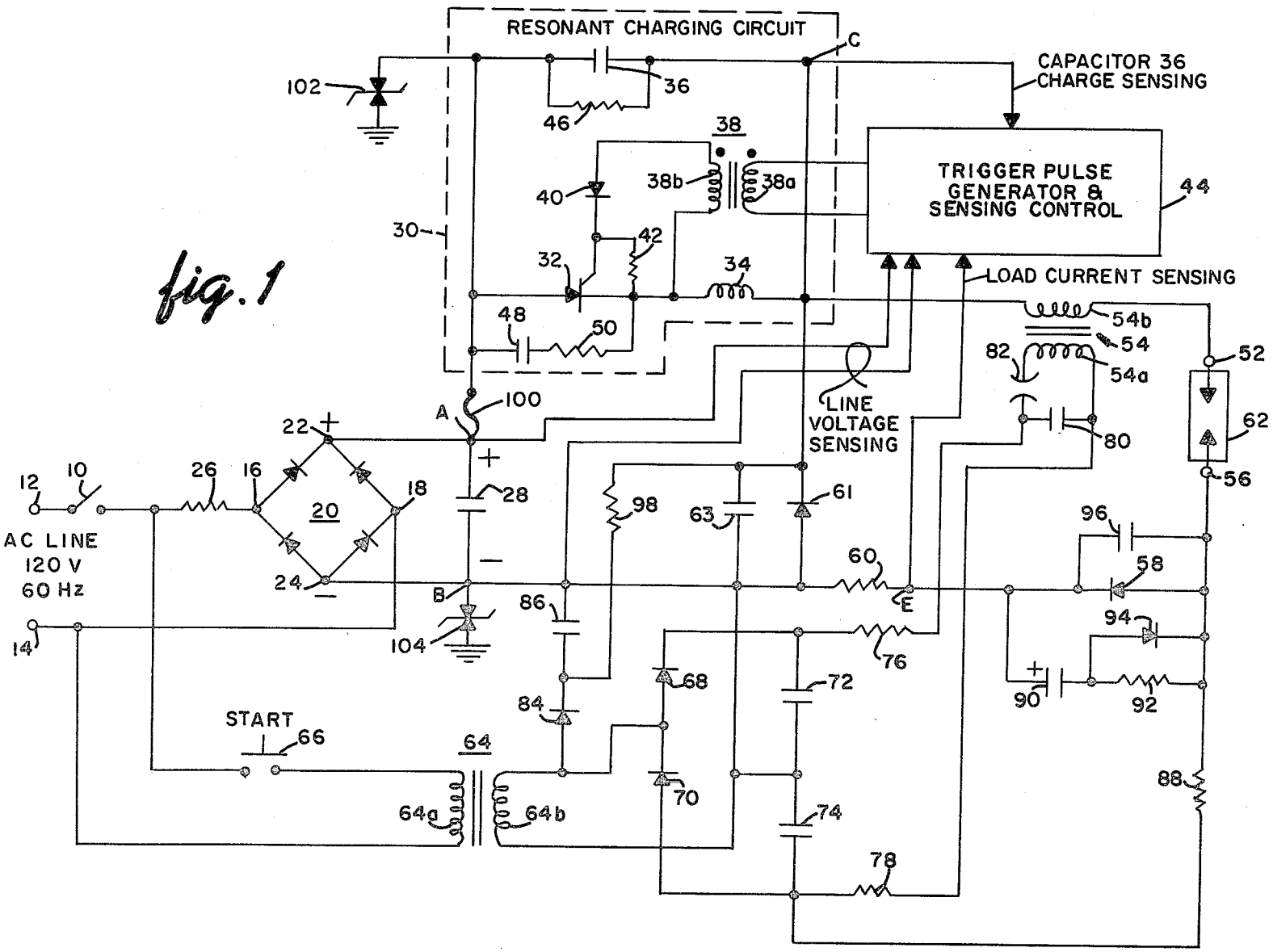
FIG. 1 is a schematic diagram of a control circuit for an arc lamp in accordance with the invention, the trigger generating circuitry being illustrated by a block representation.

Referring to FIG. 1, the control circuit includes a line switch 10 for connection to a source of alternating current (AC) line voltage represented by input terminals 12 and 14. For example, the AC source may be the typical 120 volt, 60 Hertz house current receptacle. When switch 10 is closed, the AC source is coupled to the AC input terminals 16 and 18 of a full wave, diode bridge rectifier 20 having positive (+) and negative (−) direct current (DC) output terminals 22 and 24, respectively. The rectifier input terminal 18 is shown connected directly to AC terminal 14, while the rectifier input terminal 16 is connected to switch 10 through a series resistor 26, which functions as a surge current limiting device. The DC output of rectifier 20 is filtered by means of a capacitor 28, which is connected across the output terminals 22 and 24. For convenience, the positive and negative output terminals of the filter capacitor are indicated as A and B, respectively. The filtered DC voltage output as measured across terminals A and B is hereinafter referred to as $V_{ab}$, and is typically about 160 volts DC for the above-mentioned AC input.

In accordance with the invention, the positive filter terminal A is connected to the input of a resonant charging circuit 30 comprising a unidirectional controlled switch, such as the illustrated silicon controlled rectifier (SCR) 32, an inductor 34, and a capacitor 36 serially connected in that order in a circuit loop. The input terminal of resonant circuit 30 is the junction of SCR 32 and capacitor 36, while the output terminal of the resonant circuit is the junction of inductor 34 and capacitor 36. The gate, or control electrode, of SCR 32 is connected to an operating circuit including the secondary winding **38*b* of a pulse transformer 38, a diode 40 series connected across the cathode and gate electrodes of the SCR, and a resistor 42 connected in parallel across the winding-diode combination. The primary winding 38*a* of pulse transformer 38 is energized by a trigger pulse generating circuit 44, which is represented by a block in FIG. 1 with the circuit schematic being illustrated in FIG. 2. As will be described hereinafter, the trigger circuitry 44** includes a number of sensing control circuits for providing protection against malfunction.

Each time a trigger pulse is applied through transformer 38 and diode 40 to the gate electrode of SCR 32, the SCR is triggered into conduction and a pulse of current flows in the underdamped loop including the SCR, inductor 34 and capacitor 36. This current pulse charges capacitor 36 so that the voltage at the output terminal of the resonant charging circuit rises to essentially twice the filtered DC input $V_{ab}$. For convenience, the resonant circuit output terminal is indicated as C, and the voltage charge on capacitor 36 will hereinafter be referred to as $V_c$.

Circuit 30 further includes a resistor 46 which is connected across capacitor 36 to bleed off any remaining charge when the circuit is switched off. A capacitor 48 and resistor 50 are serially connected across the SCR to function as a transient suppressor. When SCR 32 shuts off, it reverse conducts briefly, thereby causing voltage transients when this reverse conduction ceases. Transient suppressor 48, 50 acts to absorb these transients.

The output of resonant circuit 30 is connected to one of the load supply terminals 52 through a series inductor **54*b*, which functions as an averaging filter for the pulse-like output of the resonant circuit. The other load supply terminal 56 is connected to the negative DC filter terminal B through a series circuit consisting of diode 58 and resistor 60, the functions of which will be discussed hereinafter. The negative DC filter terminal B is also connected through a back swing diode 61 to the output of resonant circuit 30, the diode 61 having a capacitor 63** connected thereacross.

In the preferred embodiment, the load connected across the supply terminals 52 and 56 comprises an arc discharge lamp 62. In one particular implementation of the invention, lamp 62 is a 300 watt metal halide short arc lamp. Accordingly, inductor **54*b* is selected to have a comparatively large inductance value so that is provides the additional function of lamp ballast to provide an essentially constant current for lamp 62**.

The schematic of FIG. 1 also includes starting circuitry for providing the necessary voltages to initiate and sustain electrical conduction through the arc lamp. For this purpose, the AC input is coupled to the primary winding **64*a* of a step up transformer 64. More specifically, as shown, AC terminal 14 is connected directly to one end of winding 64***a*, while AC terminal 12 is connected through line switch 10 and a momentary push button type "start" switch 66 to the other end of winding 64*a*. The starting circuitry actually comprises two different circuits, one for introducing a high voltage pulse to initiate electrical conduction through arc lamp 62, and the other circuit for supplying an intermediate voltage level for carrying the conduction breakdown region of the lamp through to a point where the source of constant power from the resonant charging circuit can operate the lamp.

The high voltage pulse supply will be described first. It comprises a voltage doubler formed by diodes 68 and 70 and capacitors 72 and 74. The doubler input is connected to the secondary winding 64*b* of the step-up transformer 64, while the doubler output is coupled through resistors 76 and 78 to a pulse forming circuit loop comprising a discharge capacitor 80, a spark gap switch 82 and primary winding 54*a* of a pulse transformer 54. More specifically, the voltage doubler comprises two diode-capacitor branches, and the output of the diode-capacitor branch 68, 72 is connected via series resistor 76 to the junction of the spark-gap switch 82 and capacitor 80, while the output of the diode-capacitor branch 70, 74 is connected via series resistor 78 to the junction of capacitor 80 and winding 54*a*. It will be noted from the schematic of FIG. 1, that the hereinbefore described series inductor 54*b*, which provides the dual functions of averaging filter and lamp ballast, also provides a third function as secondary winding for the starting circuit pulse transformer 54.

The circuit for aiding lamp starting by applying an intermediate voltage level comprises the above-described step-up transformer 64 and a voltage doubler circuit which includes the previously mentioned diode-capacitor branch 70, 74 (from the doubler employed in pulse starting) and a second branch comprising diode 84 and capacitor 86 series connected in that order between one side of the secondary winding 64*b* and the negative reference terminal B of the DC filter output. The output of the diode-capacitor branch 70, 74 is coupled through a series resistor 88 to a negative voltage energy store comprising a capacitor 90 having one terminal coupled to resistor 88 through a parallel circuit arrangement of a resistor 92 and diode 94, the other terminal of capacitor 90 being connected through resistor 60 to the negative DC output terminal B. Connected across this negative energy store arrangement of components 90, 92 and 94 is a blocking diode 58 having a capacitor 96 connected thereacross. The common junction of resistor 92, diode 94, diode 58 and capacitor 96 is connected to the lamp supply terminal 56.

The output of diode-capacitor branch 84, 86 is coupled through a series resistor 98 to a positive voltage energy store comprising the previously mentioned capacitor 36 of the resonant charging circuit. It will be noted that the junction of resistor 98 and capacitor 36 is connected through inductor 54*b* to the lamp supply terminal 52.

Accordingly, it is clear from the foregoing description that the circuit of FIG. 1 essentially provides three different voltage supplies in an arrangement which minimizes size and cost by employing a number of the components and subcircuits for overlapping functions.

In the embodiment shown in FIG. 1, a fuse 100 is illustrated as connected between the positive DC filter terminal A and the input of the resonant charging circuit 30, and metal oxide varistors (MOV's) 102 and 104 are illustrated as connected to ground from the resonant circuit input and the DC filter terminal B, respectively. These MOV's are employed to absorb transient voltages in case the high voltage trigger arcs to ground and, in general, to minimize leakage current.

Figure 2:
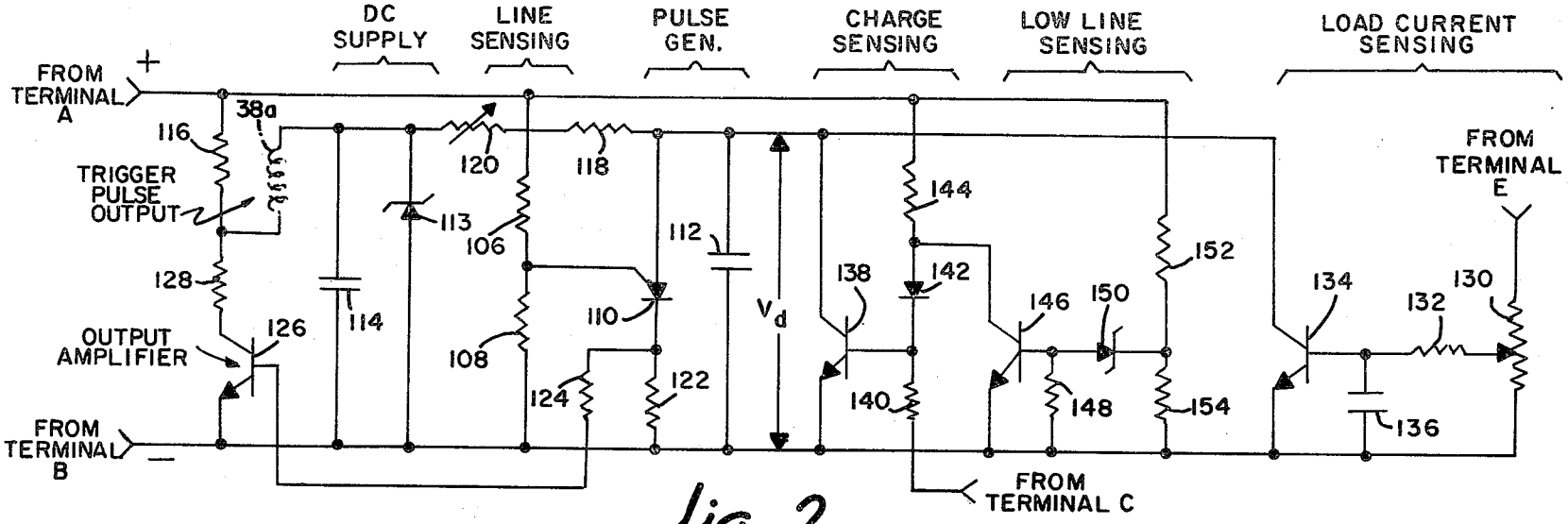
FIG. 2 is a schematic diagram of trigger generating circuitry suitable for use in the control circuit of FIG. 1.

The detail of trigger circuit 44 will now be described with reference to FIG. 2. A voltage divider comprising resistors 106 and 108 is connected across the DC filter output terminals A and B for sensing changes in the line voltage. The junction of voltage divider 106, 108 is connected to the control electrode of a unidirectional controlled switch, such as programmable unijunction transistor (PUT) 110, which together with a parallel connected capacitor 112 forms the basic trigger pulse generator. A power supply for the trigger circuitry (e.g., in the order of about 20 volts DC) is provided by a parallel circuit arrangement comprising a zener diode 113 and a capacitor 114, one terminal of this parallel circuit arrangement being connected to the negative DC terminal B, while the other terminal of the parallel circuit is serially connected through primary winding 38*a* and a resistor 116 to the positive DC filter terminal A. The junction of capacitor 112 and the anode of PUT 110 is connected to the positive side of the DC supply 112, 114 through the series arrangement of a fixed resistor 118 and variable resistor 120. The other side of capacitor 112 is connected to negative DC terminal B, and the cathode of PUT 110 is connected through a resistor 122 to the negative DC terminal B.

Basically, the trigger pulse generator operates as follows. The output of DC supply 112, 114 causes a charge to build up on capacitor 112. The firing level of PUT 110 is established by the voltage at the junction of divider resistors 106 and 108 which is connected to the control electrode of the PUT. When the voltage charge building up on capacitor 112 exceeds this firing level, the PUT 110 will be triggered into conduction, and the resulting output trigger pulse will be coupled through a series resistor 124 to the base of an amplifier transistor 126. The emitter electrode of transistor 126 is connected to the negative DC terminal B, while the collector electrode of the transistor is connected through a resistor 128 to the junction of resistor 116 and one end of the primary winding 38*a* of the pulse transformer 38 in the gate control circuit of SCR 32. Accordingly, when PUT 110 fires, the resulting trigger pulse is coupled through amplifier 126 to the primary of pulse transformer 38, which couples the pulse to fire the SCR in the resonant charging circuit 30. By virtue of the voltage divider 106, 108, however the pulse rate of the trigger generating circuit is adjusted in response to any changes in the line voltage as sensed by changes in the voltage across DC output terminals A and B. Hence, if the line voltage, and thus $V_{ab}$, is higher than normal, then the divider output voltage on the control electrode of PUT 110 will be higher. This in turn will require capacitor 112 to charge to a higher voltage before the PUT fires; thus, the charging period is increased, and the frequency of the trigger generator, and thus the output pulse rate, will be reduced. In like manner, if the line voltage decreases, the sensing provided by divider resistors 106 and 108 will cause the firing level of the PUT to be reduced so that it will fire when capacitor 112 charges to a lower voltage level. This results in a shorter charging period and thus an increase in the trigger pulse rate.

The overall circuit operation will now be described, after which the protective sensing means and the trigger circuitry will be discussed. Referring to FIG. 1, the circuit operation is initiated by closing the line switch 10 and depressing the start button 66 to energize the primary winding of step-up transformer 64. Diode 84 rectifies the output of transformer 64 and raises the positive energy store voltage, $V_c$, of capacitor 36 to approximately +300 volts. This serves the purpose of backbiasing SCR 32 during the starting interval and also places a +300 volt bias on the lamp supply terminal 52, which in a preferred embodiment is connected to the lamp anode. The voltage doubler consisting of diodes 68 and 70 and capacitors 72 and 74 provides charging voltages for capacitors 80 and 90. Capacitor 80 charges slowly and discharges through the spark gap switch 82 into the primary winding 54*a* of pulse transformer 54, which steps up the voltage to that necessary to break down the arc lamp 62 (for one embodiment, this is about 25 KV), i.e. the circuitry driving pulse transformer 54 introduces a high voltage pulse to initiate electrical conduction through the arc lamp. The negative energy store represented by capacitor 90 charges to approximately −400 volts and provides the initial energy necessary to build up the arc current, and also negatively biases supply terminal 56, which in the preferred embodiment is connected to the lamp cathode, so that the total voltage across the lamp prior to breakdown is about 700 volts. This 700 volts is the previously discussed intermediate voltage level for carrying the conduction breakdown region of the arc lamp 62 through to a point where the source of constant power from the resonant charging circuit 30 can operate the lamp.

When the lamp has started, the comparatively low voltage DC circuit takes over operation of the lamp. For example, in the preferred embodiment this circuit provides about 40 volts DC across the lamp. The AC line voltage is rectified by diode bridge 20 and filtered by capacitor 28. Resistor 26 limits the initial current surge drawn from the line when the supply is turned on. Assuming the lamp to be on, the operation of the circuit is as follows, referring to the wave forms shown in FIG. 3. The upper set wave forms in FIG. 3 refers to the DC pulse output of resonant circuit 30, namely, $V_c$, while the lower set of wave forms refer to the voltage charge build up on capacitor 112 in the trigger pulse generator, this voltage being denoted as $V_d$. Various points in time during the voltage pulse of $V_c$ are indicated by $\tau_1$ through $\tau_4$. Prior to $\tau_1$, SCR 32 is blocking the voltage from capacitor 28 and point C is at zero volts, all voltages being referenced to the negative side of capacitor 28 (terminal B). At $\tau_1$, SCR 32 is triggered by means of a trigger pulse applied through transformer 38 from trigger circuit 44, and a pulse of current flows in the underdamped circuit loop comprising inductor 34, capacitor 36 and SCR 32. This current pulse charges capacitor 36 so that the voltage at terminal C rises to essentially twice the supply voltage, i.e. $V_c$ rises to nearly $2V_{ab}$. SCR 32 is now reverse biased and the flow of current ceases. Capacitor 36 now discharges through inductor 54*b* and lamp 62. As previously mentioned, inductor 54*b* has a large inductance so that it functions as a ballast to maintain a substantially constant lamp current. The length of time it takes for capacitor 36 to discharge is determined by the load current.

A principle feature of the present invention is the use of the resonant charging circuit 30 to provide constant power to the load. If the firing rate of SCR 32 is maintained constant, the output voltage and current from the supply (terminals 52 and 56) are self-adjusting to give constant power. This power is the energy stored in capacitor 36 multiplied by the firing rate of SCR 32, as illustrated by the formula below:

$$P_{out}=\tfrac{1}{2}C_{36}\,(2V_{ab})^2\times \text{P.R.F.}$$

For proper circuit operation, there are certain constants on the values of output voltage and current. Clearly, the average output voltage cannot be greater than $V_{ab}$, which is typically about 160 volts DC. The time for which SCR 32 is reversed bias, which is the period between $\tau_2$ and $\tau_3$, is a function of both $V_{ab}$ and load current. This time must be greater than the required turn off time of SCR 32.

The various modes of protective sensing circuitry will now be described with reference to both FIGS. 1 and 2. Series resistor 60 in FIG. 1 functions as a current sensing resistor, and the junction of resistor 60 and diode 58 will be referred to as terminal E. The load current through the lamp is monitored by a voltage divider comprising a combination of a potentiometer 130 together with the resistor 60, PUT 130 being connected between terminal E and the negative DC terminal B. The variable tape on potentiometer 130 is connected through a fixed resistor 132 to the base electrode of a transistor 134. The collector and emitter electrodes of transistor 134 are connected across capacitor 112 of the pulse generator. A capacitor 136 is connected across the base and emitter electrodes of transistor 134, and the junction of one end of potentiometer 130, capacitor 136 and the emitter of transistor 134 are connected in common to the negative DC terminal B. Resistor 60 and 132 together with potentiometer 130 function as a bias circuit for causing transistor 134 to be normally in a non-conducting state. If the load current exceeds a predetermined threshold level, as a preset by the tap on potentiometer 130, the bias circuit is operative to bias transistor 134 into a conducting state. When transistor 134 is rendered conducting, it shorts out capacitor 112 to prevent it from charging. Accordingly, the next trigger pulse to SCR 32 is delayed. In summary, potentiometer 130, and its associated circuitry, senses load current exceeding a predetermined threshold level and thereupon prevents the charging of capacitor 112 to delay the firing of SCR 32, thereby reducing the output power level from resonant circuit 30.

In order for the resonant charging action of capacitor 36 to occur properly, the pulse of current in the circuit loop comprising SCR 32, inductor 34 and capacitor 36 must be considerably greater than the load current. This resonant charging current is dependent upon $V_{ab}$. Accordingly, the following circuit is provided for sensing the voltage across the DC output terminals A and B (and, thereby, the relative level of the line voltage) and causing capacitor 112 to be effectively shorted out to prevent charging thereof when the line voltage falls below a predetermined level. Referring to FIG. 2, it will be noted that the base and emitter electrodes of a transistor 138 are also connected across capacitor 112 of the pulse generating circuit. The base of transistor 138 is connected through a resistor 140 to terminal C of the resonant charging circuit (FIG. 1). The transistor 138 base electrode is also connected through a diode 142 and resistor 144 to the positive DC output terminal A. In this manner, transistor 138 is biased to be normally non-conducting in the absence of a positive voltage at the resonant circuit output terminal C. The junction of diode 142 and resistor 144 is connected to the collector of a transistor 146 having an emitter connected together with the emitter of transistor 138 to the negative DC output terminal B. The bias circuit connected to the base of the transistor 146 comprises a resistor 148 connected across the base and emitter electrodes of the transistor, and a zener diode 150 connected between the base of the transistor and the junction of a pair of voltage divider resistors 152 and 154. The voltage divider 152, 154 is connected across the DC output terminals A and B for sensing the voltage thereacross. Under normal conditions, this bias circuit is energized by the output across terminals A and B to cause transistor 146 to be in a conducting state so as to bypass current from diode 142. When the line voltage, and thus $V_{ab}$, falls below a predetermined level as established by the value selected for voltage divider 152, 154, the base bias circuit renders transistor 146 non-conducting, whereupon the bypass is removed from diode 142 to permit current to flow therethrough for biasing transistor 138 into conduction. As a result, capacitor 112 is shorted out to prevent charging thereof, and, thus, the firing of SCR 32 is delayed.

Further, SCR 32 must be triggered only when the charge on capacitor 36, $V_c$, is at zero volts. As previously described transistor 138 senses $V_c$ through resistor 140 and prevents capacitor 112 from charging if $V_c$ exceeds zero. That is, transistor 138 is normally non-conducting in the absence of a positive voltage at terminal C, but when the voltage at terminal C is still positive, transistor 138 is biased into conduction. The resulting shorting out of capacitor 112 delays the firing of SCR 32 until capacitor 36 is totally discharged.

Figure 3:
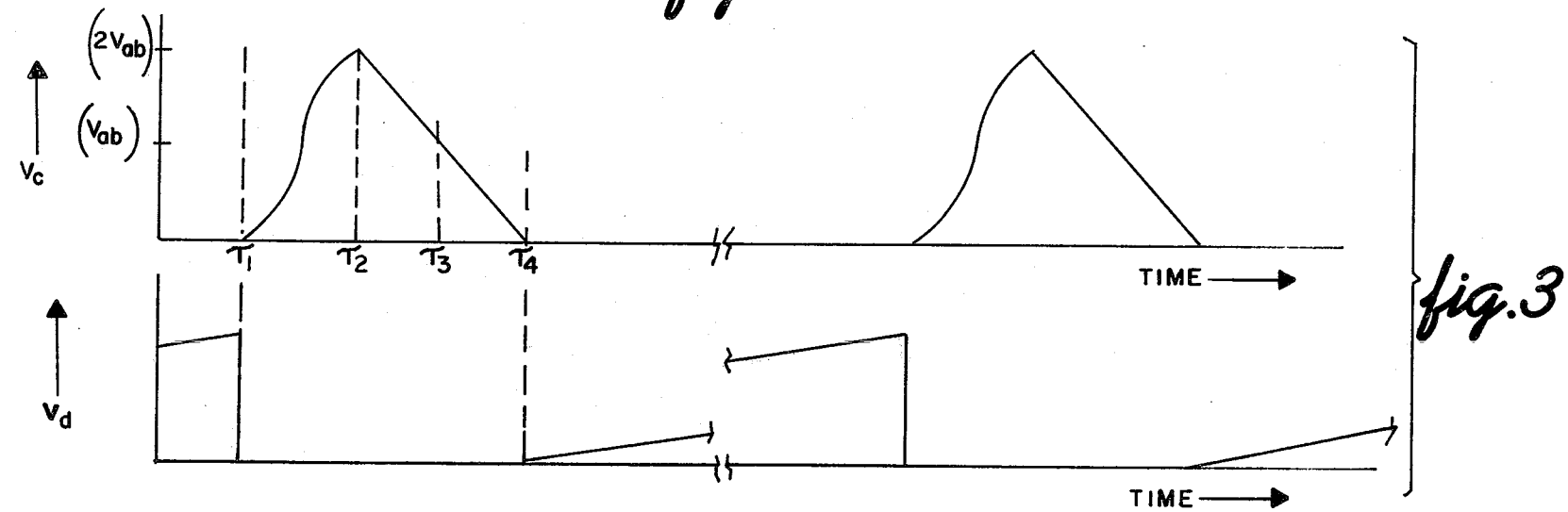
FIG. 3 shows time-referenced voltage waveform representations for designated points in the circuits of FIGS. 1 and 2.

In summary, referring again to FIG. 3, when the voltage charge on capacitor 112, $V_d$, reaches the firing level of PUT 110, SCR 32 of the resonant circuit loop will be triggered into condution. This occurs at $\tau_1$. The output of the resonant circuit occurs as a pulse $V_c$, which peaks at about $\tau_2$ at a value of about $2V_{ab}$ and then drops as capacitor 36 discharges. The SCR is reversed biased between $\tau_2$ and $\tau_3$ of the discharge. By $\tau_4$ capacitor 36 is completely discharged to zero, whereupon transistor 138 permits capacitor 112 of the pulse generator to once again begin its charge build up (voltage $V_d$) until the firing level of PUT 110 is again reached. In one specific embodiment, the time period between $\tau_1$ and $\tau_2$ is about 4 to 5 microseconds; the period between $\tau_2$ and $\tau_4$ is about 15 microseconds; and the period between pulses, while capacitor 112 is charging, is about 60 microseconds. The pulsed DC output from the resonant circuit as represented by the upper wave form of FIG. 3 is averaged out by the filtering action of inductor **54*b*** to provide a low ripple DC output for the load.

Although the described circuit can be made using component values in ranges suitable for each particular application, as is well known in the art, the following table lists component values and types for one control circuit (FIGS. 1 and 2) made in accordance with the present invention for operating a 300 watt metal halide short arc lamp.

| | |
|---|---|
| Diodes in bridge | IN4436 |
| Resistor 26 | 0.5 ohm, 25 watt |
| Capacitor 28 | 450 microfarad, 200 volts |
| SCR 32 | RCA type S5210B |
| Inductor 34 | 12 microhenries |

-continued

| | |
|---|---|
| Capacitor 36 | 0.44 microfarad |
| Transformer 38 | 25 turns/25 turns of No. 30 wire on toroid |
| Diode 40 and 142 | IN4148 |
| Resistors 42, 92, 122 and 124 | 100 ohms |
| Resistors 46, 140 and 144 | 68 K ohms |
| Capacitor 48 | 0.0068 microfarad |
| Resistor 50 | 47 ohms, 1 watt |
| transformer 54 | Pri: 3 turns, 5 strands of No. 26 wire; Sec: 125 turns, No. 16 wire; wound on ⅜" dia. × 2" long ferrite rod |
| Diode 58 | IN1206A |
| Resistor 60 | 0.1 ohm, 10 watt |
| Diode 61 | IN3893 |
| Capacitor 63 | 0.068 microfarad, 400 volt |
| Transformer 64 | 120 volts/450 volts |
| Diodes 68, 70 and 84 | Varo type VG1 |
| Capacitors 72, 74, 86 and 96 | 0.1 microfarad, 600 volts |
| Resistors 76 and 78 | 2.4 Megohms |
| Capacitor 80 | 0.22 microfarad, 600 volts |
| Spark gap switch 82 | Siemens type SG800 |
| Resistor 88 | 15K ohm |
| Capacitor 90 | 8 microfarads, 500 volts |
| Diode 94 | IN4006 |
| Resistor 98 | 27K ohm, 2 watt |
| MOV 102 and 104 | General Electric Type V130 LA10 |
| Resistor 106 | 150K ohms |
| Resistor 108 | 10K ohms |
| PUT 110 | Motorola Type MPU 131 |
| Capacitor 112 | 0.047 microfarad |
| Zener Diode 113 | IN4747 |
| Capacitor 114 | 5 microfarads, 50 volts |
| Resistor 116 | 3K ohms, 10 watt |
| Resistor 118 | 680 ohms |
| Variable Resistor 120 | 5K ohms |
| Transistor 126 | 2N3568 |
| Resistor 128 | 27 ohms |
| Potentiometer 130 | 500 ohms |
| Resistor 132 | 1K ohms |
| Transistors 134, 138 and 146 | 2N3694 |
| Capacitor 136 | 0.01 microfarad |
| Resistor 148 | 5.6K ohms |
| Zener Diode 150 | IN4747 |
| Resistor 152 | 47K ohms |
| Resistor 154 | 11 Megohms |

Although the invention has been described with respect to a specific embodiment it will be appreciated that modifications and changes may be made by those skilled in the art without departing from the true spirit and scope of the invention.

What we claim is:

1. A circuit for controlling the power applied to a load means from a source of alternating current line voltage comprising, in combination:

a full wave rectifying means having input means for connection to said source of alternating current and a pair of direct current output terminals;

a pair of supply terminals for connection to said load means;

a resonant charging circuit including a first unidirectional controlled switch means and having input and output terminals, said intput terminal being connected to a first one of the output terminals of said full wave rectifying means;

an averaging filter means connected between the output terminal of said resonant charging circuit and a first one of said supply terminals;

circuit means connecting a second one of the output terminals of said full wave rectifying means to a second one of said supply terminals;

a first diode means connected between said last-mentioned circuit means and said output terminal of said resonant charging circuit;

trigger pulse generating means coupled to said first unidirectional controlled switch means for intermittently operating the same; and means connected across the first and second output terminals of said full wave rectifying means for sensing changes in said line voltage and adjusting the pulse rate of said trigger generating means in response thereto, whereby said resonant charging circuit maintains a source of constant power to a load connected to said supply terminals regardless of line voltage variations.

2. The circuit of claim 1 wherein said resonant charging circuit comprises said first unidirectional controlled switch means, a first inductor and a first capacitor means serially connected in that order in a circuit loop, said input terminal of the resonant circuit is the junction of said first switch means and said first capacitor means, said output terminal of the resonant circuit is the junction of said first capacitor means and said first inductor means, and said first switch means includes a control electrode coupled to said trigger pulse generating means.

3. The circuit of claim 2 wherein said trigger pulse generating means comprises a second unidirectional controlled switch means connected via circuit means across an auxiliary direct current power supply, a second capacitor means connected across said auxiliary supply, and means coupling a pulse transformer between the output of said second unidirectional controlled switch means and the control electrode of said first unidirectional controlled switch means.

4. The circuit of claim 3 wherein said second unidirectional controlled switch means includes a control electrode, and said sensing and adjusting means comprises a voltage divider connected across said first and second output terminals of said full wave rectifying means and having a tap connected to the control electrode of said second switch means.

5. The circuit of claim 3 further including means for sensing the charge on said first capacitor means and causing said second capacitor means to be effectively shorted out to prevent charging thereof when the sensed charge on said first capacitor means exceeds zero.

6. The circuit of claim 5 wherein said charge sensing and short causing means comprises a first transistor having collector and emitter electrodes connected across said second capacitor means and a base electrode connected through a first resistor means to the output terminal of said resonant charging circuit, said first transistor normally being nonconducting in the absence of a positive voltage at said resonant circuit output terminal.

7. The circuit of claim 6 further including: a second resistor means and a second diode means series connected in that order between said first output terminal of said full wave rectifying means and the base of said first transistor; a second transistor having an emitter electrode connected to the emitter of said first transistor, a collector electrode connected to the junction of said second resistor means and second diode means, and a base electrode; and a bias circuit energized by said full wave rectifying means and connected to the base of said second transistor for causing said second transistor to be normally conducting so as to bypass current from said second diode means; said bias circuit being selected to render said second transistor nonconducting when said line voltage falls below a predetermined level, whereupon the bypass is removed from said second diode means to permit current to flow therethrough for biasing said first transistor into conduction, thereby shorting out said second capacitor means to prevent charging thereof.

8. The circuit of claim 3 further including means for sensing the voltage across the output terminals of said full wave rectifying means, and thereby the relative level of said line voltage, and causing said second capacitor means to be effectively shorted out to prevent charging thereof when said line voltage falls below a predetermined level.

9. The circuit of claim 3 wherein said circuit means connecting said second output terminal of said full wave rectifying means to said second supply terminal includes a first resistor connected in series between said first diode means and said second supply terminal, and further including means connected to said first resistor and cooperating therewith for sensing the current through a load connected to said supply terminals and causing said second capacitor means to be effectively shorted out to prevent charging thereof when the sensed load current exceeds a predetermined threshold level.

10. The circuit of claim 9 wherein said load current sensing and short causing means comprises: a first transistor having collector and emitter electrodes connected across and second capacitor means, and a base electrode; and a bias circuit comprising a potentiometer connected between said first resistor and the emitter of said first transistor and having a tap connected through a second resistor to the base of said first transistor for causing said first transistor to be normally nonconducting; said load current threshold level being set by said potentiometer tap, and said bias circuit being operative to bias said first transistor into a conducting state when said sensed load current exceeds said threshold level, thereby shorting out said second capacitor means to prevent charging thereof.

11. The circuit of claim 1 wherein said load means is an arc lamp, said averaging filter is a series inductor which functions as a ballast for said arc lamp, and further including a lamp starting circuit coupled to said supply terminals for introducing a high voltage pulse to initiate electrical conduction through said arc lamp.

12. The circuit of claim 11 wherein said lamp starting circuit includes a pulse transformer having primary and secondary windings, said series inductor being the secondary winding of said pulse transformer.

13. The circuit of claim 2 wherein said load means is an arc lamp, said averaging filter is a series inductor which functions as a ballast for said arc lamp, and further including a lamp starting circuit for introducing a high voltage pulse to initiate electrical conduction through said arc lamp, said lamp starting circuit comprising: a step-up transformer having a primary winding for connection to said source of alternating current and a secondary winding; a first voltage doubler having an input connected to the secondary winding of said step-up transformer and an output, said first voltage doubler having a first diode-capacitor branch and a second diode-capacitor branch connected between the input and output thereof; a pulse transformer having primary and secondary windings; and the primary of said pulse transformer being connected in a circuit loop including a switch means and discharge capacitor, said circuit loop being connected to the output of said first voltage doubler, and said series inductor being the secondary winding of said pulse transformer.

14. The circuit of claim 13 further including means for aiding said lamp starting circuit by supplying an intermediate voltage level for carrying the conduction breakdown region of the lamp through to a point where said source of constant power from said resonant charging circuit can operate the lamp, said intermediate voltage supply means comprising said step up transformer, a second voltage doubler having an input connected to the secondary of said step-up transformer and an output, said second voltage doubler having a first diode-capacitor branch and a second diode-capacitor branch connected between the input and output thereof, said first branch of said second doubler comprising the same components as the first branch of said first doubler, an energy store having a first polarity coupled to the second one of said supply terminals and to the output of said first branch of the second doubler, and an energy store having a second polarity coupled to the first one of said supply terminals and to the output of said second branch of said second doubler, said energy store of second polarity comprising said first capacitor means.

* * * * *